US006227424B1

(12) United States Patent
Roegner

(10) Patent No.: US 6,227,424 B1
(45) Date of Patent: May 8, 2001

(54) SECURITY PURSE

(76) Inventor: DeAnna Roegner, 774 Mays Blvd. #10-405, Incline Village, NV (US) 89451

( * ) Notice: Subject to any disclaimer, the term of this patent is extended or adjusted under 35 U.S.C. 154(b) by 0 days.

(21) Appl. No.: 09/501,001

(22) Filed: Feb. 9, 2000

(51) Int. Cl.[7] ..... A45C 13/30

(52) U.S. Cl. ..... 224/219; 224/222; 150/131

(58) Field of Search ..... 224/219, 222, 224/223, 660, 267; 150/131, 139, 143, 145, 147, 149

(56) References Cited

U.S. PATENT DOCUMENTS

| | | | | |
|---|---|---|---|---|
| D. 33,980 | * | 1/1901 | Mitchell | D3/230 |
| 214,823 | | 4/1879 | Hopkins . | |
| 219,564 | * | 9/1879 | Beames | 224/219 |
| D. 259,220 | * | 5/1981 | Small et al. | D2/400 |
| 781,056 | | 1/1905 | Duncan . | |
| 781,948 | * | 2/1905 | Hegele | 150/131 |
| 1,382,446 | | 6/1921 | Warren . | |
| 1,472,303 | * | 10/1923 | McGibbon | 150/139 |
| 1,526,245 | * | 2/1925 | Simek | 294/142 |
| 1,594,215 | * | 7/1926 | Sides | 206/371 |
| 1,972,480 | | 9/1934 | Gomi . | |
| 3,199,754 | | 8/1965 | Sorensen . | |
| 3,670,933 | | 6/1972 | Jones | 224/28 |
| 3,942,693 | | 3/1976 | Tocci | 224/28 |
| 4,209,048 | | 6/1980 | Sandos | 150/38 |
| 4,239,136 | * | 12/1980 | Godwin | 224/219 |
| 4,332,338 | | 6/1982 | Christiansen | 224/222 |
| 4,341,331 | | 7/1982 | McDougall | 224/219 |
| 4,461,030 | | 7/1984 | Knudsen | 224/222 |
| 4,570,688 | | 2/1986 | Williams | 150/134 |
| 4,746,043 | * | 5/1988 | Booker | 224/219 |
| 5,341,972 | * | 8/1994 | Jacks | 224/165 |
| 5,704,067 | * | 1/1998 | Brady | 2/170 |
| 5,845,826 | * | 12/1998 | Nguyen | 224/222 |
| 6,112,961 | * | 9/2000 | Phillips | 224/222 |

FOREIGN PATENT DOCUMENTS

| | | |
|---|---|---|
| 2419043 | 7/1978 | (FR) . |
| 191321 | 11/1923 | (GB) . |

* cited by examiner

*Primary Examiner*—Stephen F. Gerrity
*Assistant Examiner*—Rhonda E. Sands
(74) *Attorney, Agent, or Firm*—Baker & Maxham

(57) ABSTRACT

A security case for small valuables, comprises an arm strap for extending and detachably securing around an arm, a first pocket attached to the strap intermediate to the ends thereof, the pocket having a pliable first back panel and a transparent front panel secured together along side and bottom edges forming an envelope type first pocket, and a second pocket formed of a shell of pliable material, the shell formed of a second back panel, an enlarged front panel, the panels secured together along common side edges and a bottom edge thereby forming at least one receptacle having a top opening and a cover flap for covering said opening, the second pocket hinged along a side edge to one side edge of the first pocket and having releaseable securing members along the other side edge releaseably securing the second pocket over the first pocket.

18 Claims, 2 Drawing Sheets

SECURITY PURSE

BACKGROUND OF THE INVENTION

The present invention relates to a security case and, more particularly to an arm mountable purse for maintaining the security of personal valuables.

The security of certain valuable items such as drivers license, credit cards, cash and jewelry normally carried by a person in a pocket or purse is often a major concern in many situations. In certain situations it is not advisable to carry a purse and in other situations in is not convenient to carry a purse or a wallet. For example in certain areas of cities thieves and purse snatchers make it advisable not to carry a purse in the conventional manner. In these areas one must also protect one's wallet and other valuables against pick-pockets.

There are other situations such as when one is playing certain sports or at a beach swimming or surfing, where it is not convenient to carry a purse or a wallet. For this reason some provision must be made to secure valuables such as money, credit cards, jewelry and the like.

Money belts may be used in certain situations such as in cities where thieves, pickpockets and purse snatchers are prevalent. However such money belts are not convenient to use by swimmers and surfers at the beach or when playing sports. The state security of money and other valuables in is a problem.

Therefore there is a need for means to safely secure money and other valuables in the aforementioned situations.

Accordingly it is desirable that there be available a security case that provides ample storage for security assorted personal valuable items in a simple and convenient manner.

SUMMARY AND OBJECTS OF THE INVENTION

It is the primary object of the present invention to provide a security case with multiple pockets for holding valuables in a secure and readily accessible manner.

It is another object of the present invention to provide a security case, which is attachable by a strap to an arm or wrist to provide convenience and security of personal valuable items.

In accordance with a primary aspect of the invention a security case for small valuables, comprises an arm strap for extending and detachably securing around an arm, a first pocket attached to the strap intermediate to the ends thereof, the pocket having a pliable first back panel and a transparent front panel secured together along side and bottom edges forming an envelope type first pocket, and a second pocket formed of a shell of pliable material, the shell formed of a pliable second back panel, an enlarged front panel, the panels secured together along common side edges and a bottom edge thereby forming at least one receptacle having a top opening and a cover flap for covering said opening, the second pocket hinged along a side edge to one side edge of said first pocket and having releasable securing means along the other side edge releasably securing the second pocket over the first pocket.

BRIEF DESCRIPTION OF THE PREFERRED EMBODIMENTS

The above and other objects and advantages of the present invention will become apparent from the following description when read in conjunction with the accompanying drawings wherein.

DETAILED DESCRIPTION OF THE PREFERRED EMBODIMENTS

Figure 1:
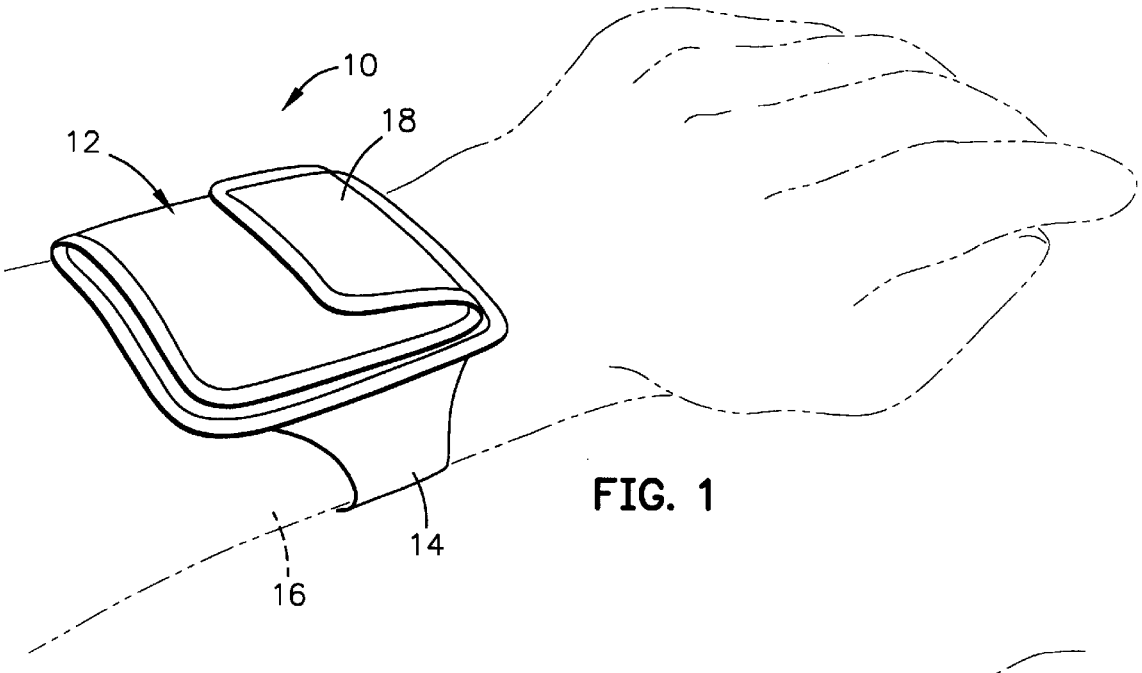
FIG. 1 is a perspective view of an exemplary preferred embodiment of the invention with the security case closed and shown in a typical wearing position.

Referring to FIGS. 1 through 4 of the drawing, an exemplary embodiment of a wrist mountable case in accordance with the invention is illustrated and designated generally by the numeral 10. The case is preferably constructed of a pliable material such as leather, vinyl, nylon, or any of the other suitable woven materials now widely used for wallets, handbags, purses, suitcases and the like.

Figure 2:
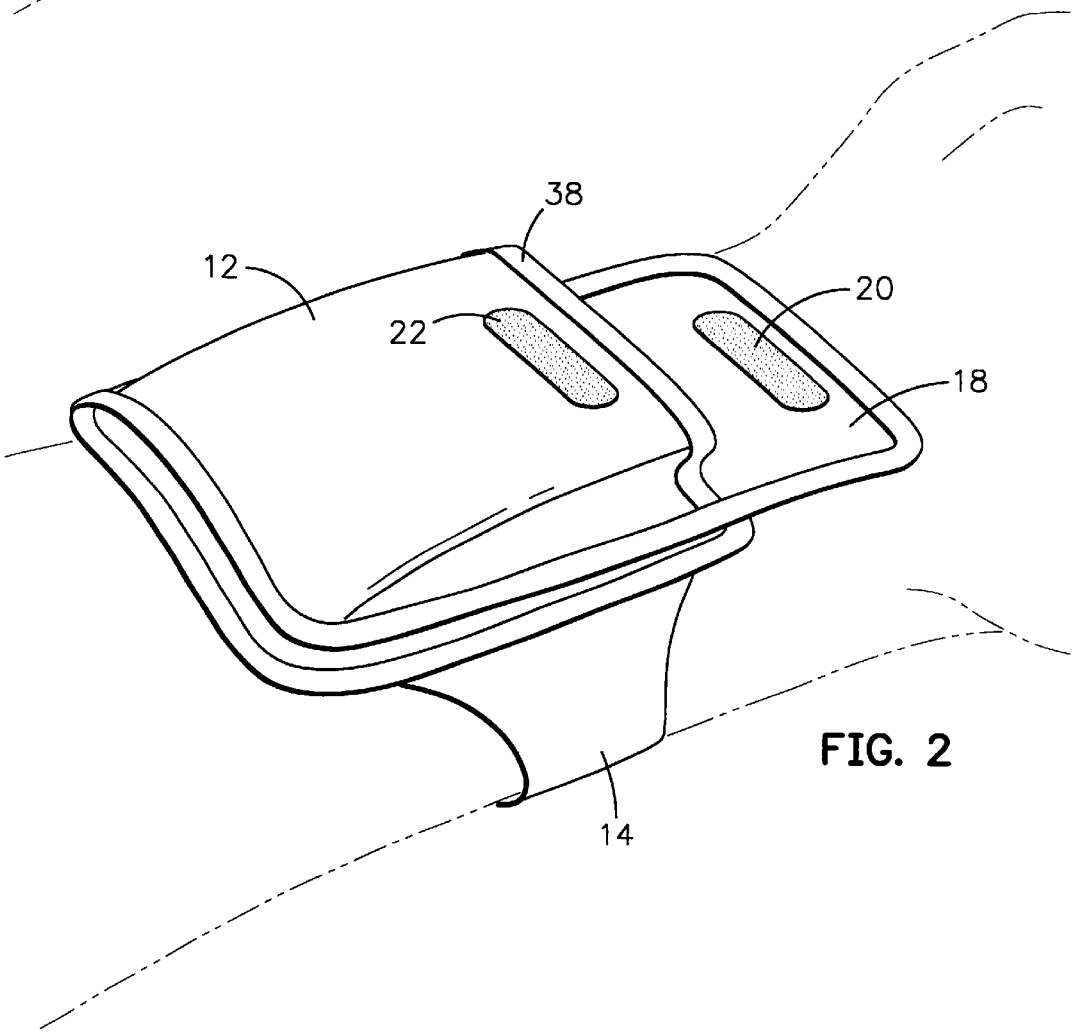
FIG. 2 is a view like FIG. 1 with the case shown open.

As particularly shown in FIGS. 1 and 2, there is illustrated a security purse or wallet in accordance with an exemplery preferred embodiment of the invention designated generally by the numeral 10. The case in accordance with the invention comprises a generally pocket-like first or upper compartment 12 constructed of pliable panels of a suitable pliable material such as leather, vinyl, fabric or materials suitable for purses, wallets and the like. The case in accordance with one aspect of the invention is mounted on or secured to a strap 14, which is shown secured around a wrist or arm 16 shown in phantom. It will be appreciated that the case can be secured around the arm at any position such as the upper arm or the like or around the ankle when convenient.

The upper or main compartment 12 as shown in FIG. 2 has an opening which is closed or secured by a flap or closure 18 secured in place or in a closed position by suitable fastening means such as hook and loop fastening means 20 and 22. The pocket or receptacle 12 is formed as can be seen in FIG. 2 by a pocket panel with foldable and expendable sides to provide anexpandable receptacle as required by articles placed therein. The pocket is adapted to accommodate keys, money, jewelry and other small valuables.

Figure 3:
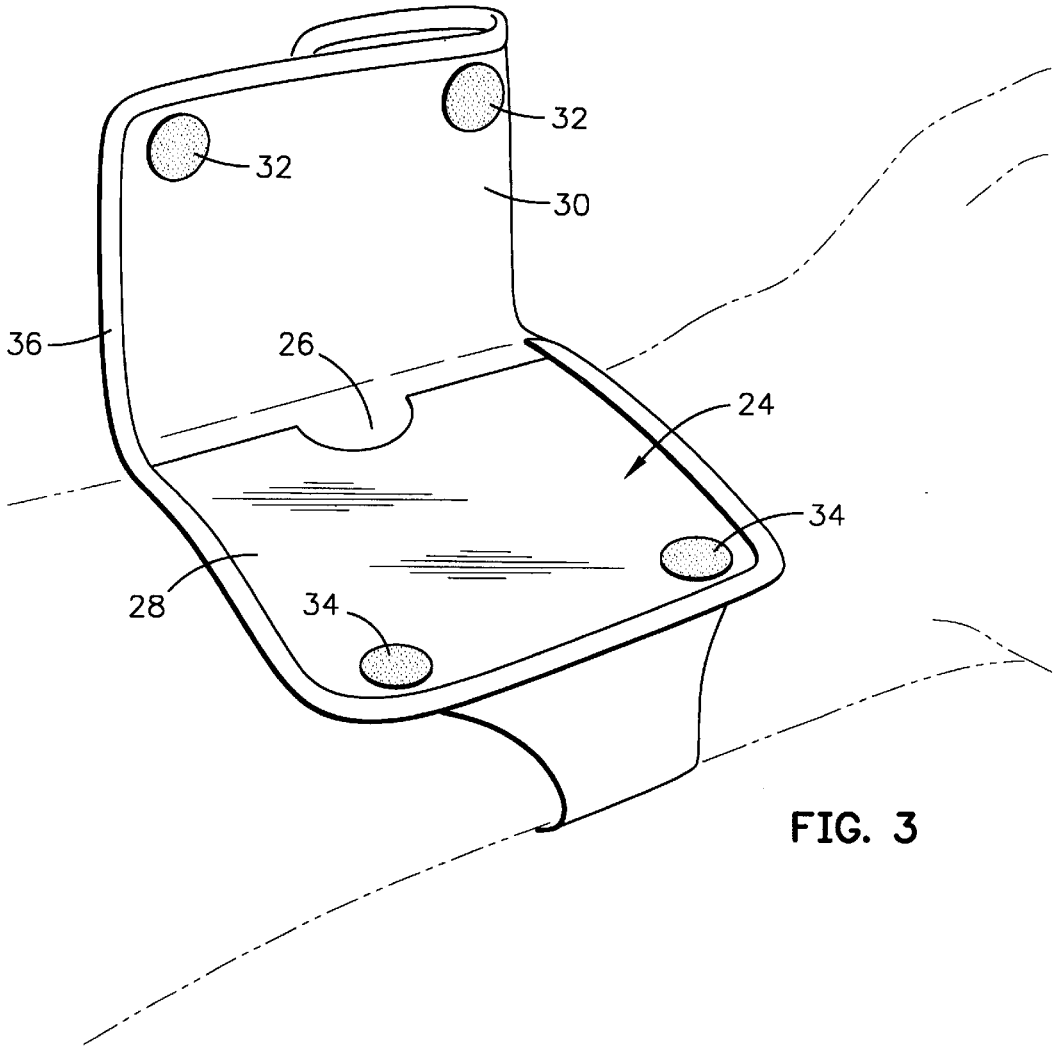
FIG. 3 is a view like FIG. 1 with the case shown pivoted back to reveal an underlying compartment.

Referring to FIG. 3, the case is shown with the upper pocket assembly 12 pivoting away from a lower or inner pocket assembly 24 of an envelope-type construction. The upper pocket assembly forms or provides a closure for the lower or inner pocket. The inner pocket assembly is formed of a back panel 26 of fabric such as nylon, leather or the like. The front panel is formed of a transparent material such as clear vinyl or the like. This provides a pocket assembly for receipt and holding of I.D. cards, driver's licenses, credit cards and the like. As will be appreciated from FIG. 3, the entire pocket assembly may be constructed of one continuous sheet of fabric material forming back panel 26 for the lower pocket, a back panel 30 for the upper pocket assembly and the closure or flap 18 for the upper pocket. Similarly, these may be separate panels secured together along one or more seams.

As seen in FIG. 3 the upper panel assembly pivots away along a top edge of the lower panel assembly and pivots over or on top thereof and secured in place such as by suitable securing means as hook and loop fastening means 32 and 34. As illustrated, the upper pocket assembly forms a closure for the lower pocket assembly pivoting or pivotally secured or formed thereon along the edge at the opening thereof. The upper pocket assembly, as can best be seen in FIG. 2 is constructed of a front pocket panel secured along its opposite side and its bottom edge to the back panel 30. The joining seams and outer edges of the respective panels are covered or finished off by a finishing strip 36 sewn or secured along the edges of the panels. This finishing strip may be continuous as illustrated and extend along the entire outer edge of the panel forming the majority of the pocket assembly. A second finishing strip 38 finishes the upper edge or opening edge of the upper pocket assembly.

Figure 4:
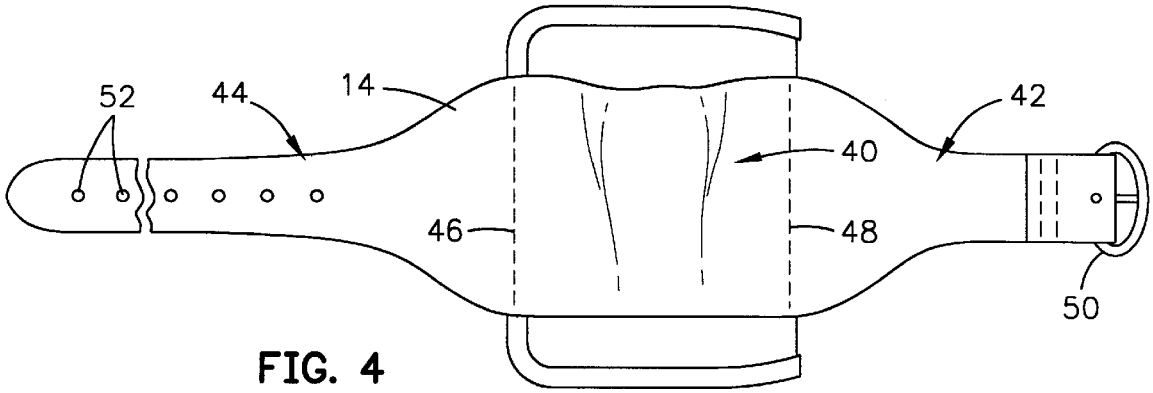
FIG. 4 is a bottom view of the invention og FIG. 1 showing the connection of the wrist strap to the case and an additional holder.

Referring to FIG. 4, the wrist strap 14 is formed with an enlarged or wider center section 40 where the case is attached, and narrowed end sections 42 and 44 where a buckle or other detachable securing means is provided. The strap is preferably made of an elastic material with the center section secured along seams 46 and 48 to the back panel of the pocket assembly 24. This leaves or forms an open-ended collapsible tubular space between the wrist strap and the back panel for securing receiving a comb, pen, pencil or the like.

The wrist strap may be made out of any suitable material including a stretchable elastomeric material. In a similar manner, the entire pocket assembly may be made of any suitable pliable material including stretchable materials and waterproof materials.

The wrist strap is shown with a buckle 50 at one end and a series of holes or perforations 52 at the other end for releaseably securing the strap around a limb of a person. However, it is apparent that any suitable securing means including hook and loop fastening means may be utilized.

While my invention has been illustrated and described by means of a particular embodiment, it is to be understood that numerous changes and modifications may be made therein without departing from the spirit and the scope thereof as defined in the appended claims.

I claim:

1. A security case for small valuables, comprising:

an arm strap for extending and detachably securing around an arm;

a first pocket attached to the strap intermediate to the ends of the strap the pocket having a pliable first back panel and a transparent front panel secured together along side and bottom edges forming an envelope type first pocket; and a second pocket formed of a shell of pliable material, the shell formed of a pliable second back panel, an enlarged front panel, the panels secured together along common side edges and a bottom edge thereby forming at least one receptacle having a top opening and a cover flap for covering said opening, the second pocket hinged along a side edge to one side edge of said first pocket and having releaseable securing means along the other side edge releaseably securing the second pocket over the first pocket.

2. The security case of claim 1, wherein the first back panel is secured to the arm strap.

3. The security case of claim 2, wherein the first back panel is secured to the arm strap along side edges of said first back panel leaving space between said first back panel and said strap for receipt of a comb or brush.

4. The security case of claim 3, wherein said releaseable securing means is a combination hook and loop fastening means.

5. The security case of claim 4, wherein said arm strap is an elongated elastic strap.

6. The security case of claim 1, wherein said releaseable securing means is a combination hook and loop fastening means.

7. The security case of claim 6, wherein said arm strap is an elongated elastic strap.

8. The security case of claim 7, wherein said elongated elastic strap is wider where secured to the back panel and forms article carrying space there between.

9. The security case of claim 1 wherein said second pocket forms a closure for said first pocket.

10. The security case of claim 9 wherein said second pocket is releasably securable over said first pocket by hook and loop fastening means.

11. The security case of claim 1 wherein said second pocket is along an axis of an arm on which it is mounted and said first pocket opening is transverse to an arm on which the case is mounted.

12. An arm mountable security case for small valuables, comprising:

an arm strap for extending and detachably securing around an arm;

a first pocket attached to the strap intermediate to the ends of the strap the pocket formed of a pliable first back panel and a transparent front panel secured together along side and bottom edges forming an open top envelope type first pocket having an opening in a first direction; and a second pocket formed of a shell of pliable material, the shell formed of a pliable second back panel, an enlarged front panel, the panels secured together along a common side edge and a bottom edge thereby forming at least one receptacle having a top opening in a second direction and a cover flap for covering said opening, the second pocket hinged along an edge adjacent to said top opening of said first pocket and having hook and loop securing means along another side edge releaseably securing the second pocket as a closure over the first pocket.

13. The security case of claim 12, wherein said first back panel is secured to the arm strap.

14. The security case of claim 12, wherein said first back panel is secured to the arm strap along side edges of said first back panel leaving space between said first back panel and said strap for receipt of a comb or brush.

15. The security case of claim 14, wherein said arm strap is an elongated elastic strap.

16. The security case of claim 13, wherein said strap is wider where secured to the back panel and forms article carrying space therebetween.

17. The security case of claim 12 wherein said second pocket is along an axis of an arm on which it is mounted and said first pocket opening is transverse to an and arm on which the case is mounted.

18. An arm mountable carrying case for small valuables, comprising: an elastic arm strap for extending and detachably securing around an arm, said arm strap being wider at the center thereof than at the ends; a first pocket formed of a pliable first back panel and a transparent front panel secured together along side and bottom edges forming an open top envelope type first pocket having an opening in a first direction, said first back panel secured to the arm strap along side edges of said first back panel, leaving space between said first back panel and said strap for receipt of articles; and a second pocket formed of a shell of pliable material, the shell formed of a pliable second back panel, an enlarged front panel, the panels secured together along a common side edge and a bottom edge thereby forming at least one receptacle having a top opening in a second direction and a cover flap for covering said opening, the second pocket hinged along an edge adjacent to said top opening of said first pocket and having releasable securing means along another side edge releasably securing the second pocket as a closure over the first pocket.

* * * * *